US008205935B2

(12) United States Patent
Tang

(10) Patent No.: US 8,205,935 B2
(45) Date of Patent: Jun. 26, 2012

(54) COLLAPSIBLE STOOL FOR EASY STORAGE

(75) Inventor: Hongyan Tang, Wuxi (CN)

(73) Assignee: The FHE Group Inc., Concord, Ontario (CA)

( * ) Notice: Subject to any disclaimer, the term of this patent is extended or adjusted under 35 U.S.C. 154(b) by 0 days.

(21) Appl. No.: 13/048,732

(22) Filed: Mar. 15, 2011

(65) Prior Publication Data

US 2011/0162560 A1 Jul. 7, 2011

(51) Int. Cl.
*A47C 4/00* (2006.01)

(52) U.S. Cl. ..... 297/17

(58) Field of Classification Search ..... 297/17, 297/16.1, 423.41, 440.1, 461, 452.57, 462, 297/188.09, 440.12; 108/157.14, 34, 11
See application file for complete search history.

(56) References Cited

U.S. PATENT DOCUMENTS

| | | | | | |
|---|---|---|---|---|---|
| 2,361,875 | A * | 10/1944 | Sachs | ..... | 108/165 |
| 2,449,017 | A | 9/1948 | Smiler | | |
| 3,501,197 | A * | 3/1970 | Burton | ..... | 297/232 |
| 3,663,058 | A * | 5/1972 | Hirsch | ..... | 297/423.41 |
| 4,881,779 | A * | 11/1989 | Bubien | ..... | 297/440.13 |
| 5,697,675 | A * | 12/1997 | DeWitt et al. | ..... | 297/440.12 |
| 7,581,786 | B1 * | 9/2009 | Wang | ..... | 297/188.11 |
| 2005/0204968 | A1 * | 9/2005 | Butkus et al. | ..... | 108/157.14 |

FOREIGN PATENT DOCUMENTS

| | | | |
|---|---|---|---|
| CN | 201303753 | | 9/2009 |
| JP | 2001037586 | A * | 2/2001 |
| JP | 2002106165 | A * | 4/2002 |

* cited by examiner

*Primary Examiner* — Milton Nelson, Jr.
(74) *Attorney, Agent, or Firm* — Leason Ellis LLP

(57) ABSTRACT

A collapsible stool for easy storage, comprising a collapsible, bench body member, a bench body support panel; and a bench cap. When in use, the bench cap is mounted on the bench body member in its expanded state. The bench body member, in its expanded state, forms a four-sided cylindrical body. Each of the four walls of the four-sided cylindrical body is made of a soft exterior layer, and a solid composite panel that is enclosed within the soft exterior layer. The bench cap is a non-collapsible cap-shaped body that is formed from a bench cap surface member, and bench cap walls to which the bench cap surface member is connected. The bench cap surface member and the bench cap walls are made of a soft exterior layer, and a solid composite panel enclosed within the soft exterior layer. When stored, the bench body support panel and the collapsed bench body member of the present collapsible stool are disposed in the non-collapsible bench cap, forming a single unit that is convenient for storage and transportation.

2 Claims, 2 Drawing Sheets

COLLAPSIBLE STOOL FOR EASY STORAGE

FIELD OF THE INVENTION

The present invention relates generally to stools, and more specifically, to a collapsible stool.

BACKGROUND OF THE INVENTION

There are limited number of benches in buses and ferries. Passengers need portable stools that occupy less space, and that can be stored conveniently. Known in the art are small folding stools. This type of stool has a foldable bench body member; a bench body support panel; and a foldable bench cap. The bench cap fits on top of the foldable bench body member. The foldable bench body member, in its expanded state, forms a four-sided cylindrical body. Each of the four walls of the four-sided cylindrical body is made of a soft exterior layer, and a solid composite panel that is enclosed within the soft exterior layer. The bench cap is a cap-shaped body that is formed from a bench cap surface member, and bench cap walls to which the bench cap surface member is connected. The bench cap surface member and the bench cap walls are made of a soft exterior layer, and a solid composite panel enclosed within the soft exterior layer. The bench body member and the bench cap are foldable; thereby reducing the size of the stool when not in use. However, upon folding the bench cap and the bench body member, they become separate pieces that cannot be conveniently transported nor stowed away for storage. There is thus a need for a collapsible stool that addresses shortcomings generally associated with the prior art.

SUMMARY OF THE INVENTION

An objective of the present invention is to provide a collapsible stool for easy storage which addresses the above-mentioned shortcomings found in existing folding stools, such that upon collapsing the collapsible stool of the present invention, the size of the stool is reduced, and the bench cap, the bench body member, and the bench body support panel can be stored as a single unit that is easy for storage or transportation.

A broad aspect of the present invention provides a collapsible stool for easy storage. The collapsible stool comprises a collapsible bench body member, a bench body support panel, and a bench cap. The bench body support panel fits within and supports the bench body member in its expanded state. The bench cap is mounted on the bench body member in its expanded state. The bench body member, in its expanded state, forms a four-sided cylindrical body. Each of the four walls of the four-sided cylindrical body is made of a soft exterior layer and a solid composite panel that is enclosed within the soft exterior layer. The bench cap is a non-collapsible cap-shaped body that is formed from a bench cap surface member and bench cap walls to which the bench cap surface member is connected. The bench cap surface member and the bench cap walls are made of a soft exterior layer and a solid composite panel enclosed within the soft exterior layer. When stored, the bench body support panel and the collapsed bench body member of the present collapsible stool are disposed in the non-collapsible bench cap.

In at least one embodiment of the present collapsible stool, when the bench body support member and the collapsed bench body member are disposed in the non-collapsible bench cap, the total thickness of the bench body support member and the collapsed bench body member is the same as the height of the bench cap inner walls.

The present collapsible stool when stored, where the bench body support member and the collapsed bench body member are disposed in the non-collapsible bench cap, forms a single unit that is convenient for storage or transportation.

BRIEF DESCRIPTION OF THE DRAWINGS

Further features of the present invention will become apparent from the following written description and the accompanying drawings and the appended claims in which:

DETAILED DESCRIPTION OF THE INVENTION

Figure 1:
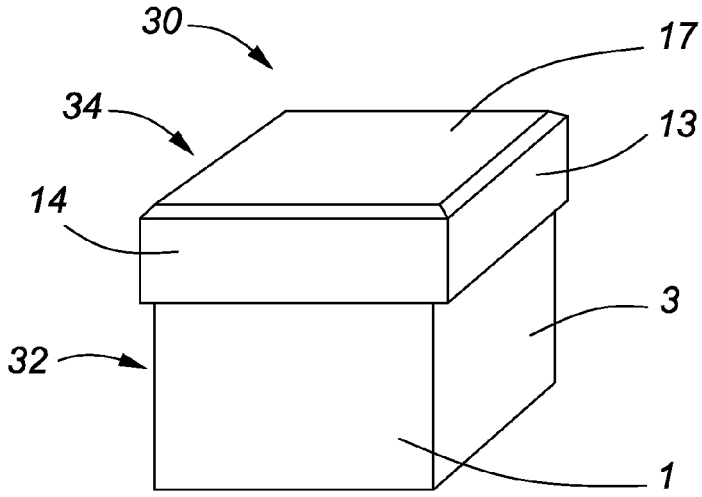
FIG. 1 is a perspective view of an embodiment of the present collapsible stool in its assembled state for use.

FIG. 1 shows at least one embodiment of the present collapsible stool 30. Collapsible stool 30 comprises collapsible bench body member 32; bench body support panel 19; and bench cap 34. Bench cap 34 fits on top of bench body member 32 when bench body member 32 is in its expanded state.

Figure 3:
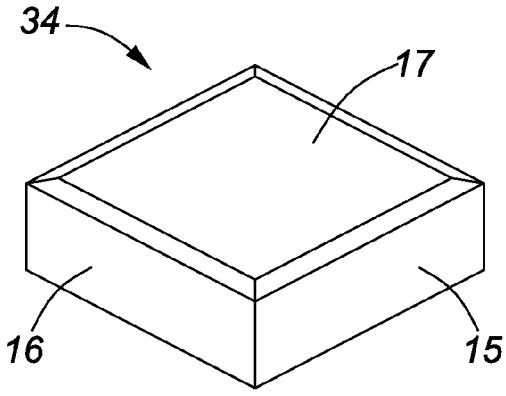
FIG. 3 is a perspective view of a bench cap of the collapsible stool of FIG. 1.
Figure 4:
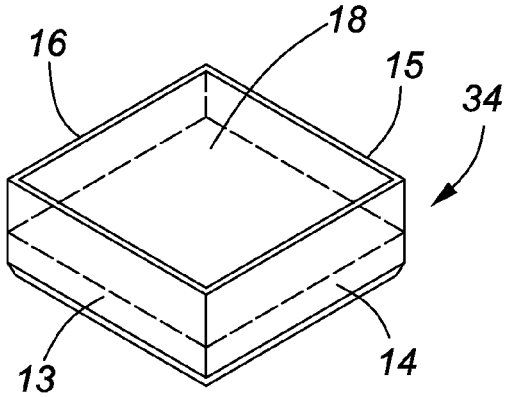
FIG. 4 is a perspective view of the bench cap of FIG. 3 when inverted.

Referring to FIGS. 3 and 4, bench cap 34 is a cap-shaped body that is formed from bench cap surface member 17 and bench cap walls 13, 14, 15, 16 to which bench cap surface member 17 is connected. Bench cap surface member 17 and bench cap walls 13, 14, 15, 16 are quadrilateral. Each of the bench cap walls 13, 14, 15, 16 are connected to a respective side of bench cap surface member 17 so that bench cap surface member 17 and bench cap walls 13, 14, 15, 16 are connected together as shown in FIGS. 3 and 4.

In FIGS. 3 and 4, between bench cap surface member 17 and solid layer 18 is a padded layer of sponge-like material (not shown).

Figure 5:
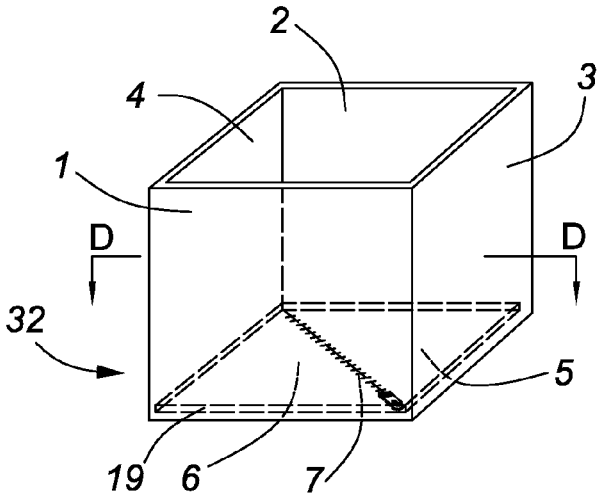
FIG. 5 is a perspective view of a bench body member of the collapsible stool of FIG. 1 in its expanded state.
Figure 6:
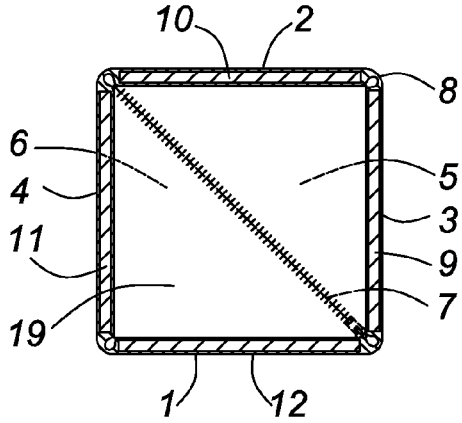
FIG. 6 is a cross-sectional view of FIG. 5 taken along line D-D.

As shown in FIGS. 5 and 6, bench body member 32, in its expanded state, forms a four-sided cylindrical body. The four-sided cylindrical body is formed with a soft exterior layer and solid composite panels 9, 10, 11, 12 that are enclosed within the soft exterior layer. Between the soft exterior layer and solid composite panels 9, 10, 11, 12 is area 8 which is free of solid composite panel, enabling bench body member 32 to be collapsible. Connected to one end of the four-sided cylindrical body, opposed to the other end where bench cap 34 is fit onto bench body member 32, are soft sealable members 5, 6. Between soft sealable members 5, 6 is a zipper 7. Bench body support panel 19 is placed on top of soft sealable members 5, 6 to provide stability to bench body member 32 in its expanded state, and to provide support to bench body walls 1, 2, 3, 4.

Another aspect of the present invention is a method for setting up the present collapsible stool for use, and for collapsing the present collapsible stool for storage or transportation.

Referring to FIG. 5, the four bench body walls 1, 2, 3, 4 can be unfolded, the soft sealable members 5, 6 fastened together with zipper 7, and the bench body support panel 19 mounted on top of soft sealable members 5, 6. Next, the bench cap 34 can be placed on top of bench body member 32 of FIG. 5 to form the present collapsible stool 30 of FIG. 1 when in use.

Figure 2:
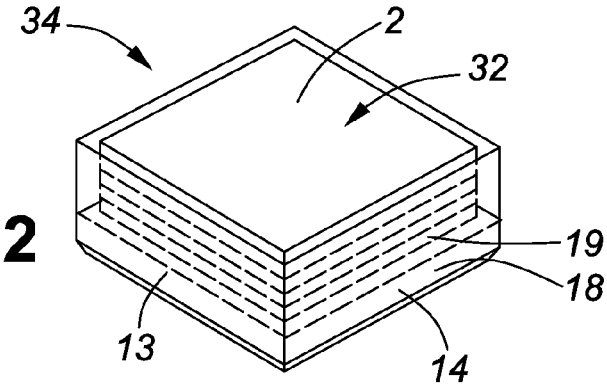
FIG. 2 is a perspective view of the collapsible stool of FIG. 1 in its collapsed state for storage.
Figure 7:
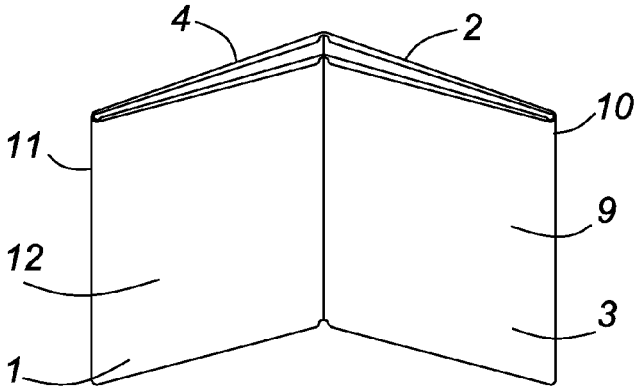
FIG. 7 is the bench body member of FIG. 5 in its partially collapsed state.
Figure 8:
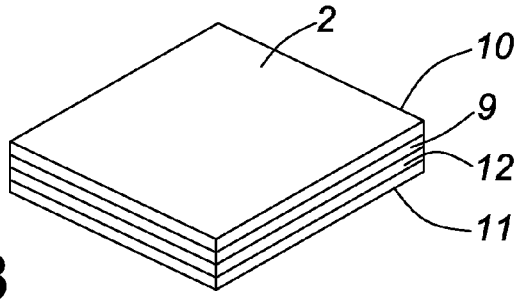
FIG. 8 is the bench body member of FIG. 5 in its fully collapsed state.

To collapse the present collapsible stool 30 for storage or transportation, remove bench cap 34 from bench body member 32. Collapse bench body member 32 in the order shown in FIGS. 7 and 8. Referring to FIG. 2, put bench body support panel 19 on solid layer 18 of bench cap 34, then put the collapsed bench body member 32 on top of bench body support panel 19, so that bench cap 34, collapsible bench body member 32, and bench body support panel 19 form a single unit, while at the same time, the sum of the thickness of bench body support panel 19 and that of the collapsed bench body member 32 is equal to the height of the bench cap inner walls, making the present collapsible stool convenient for storage and transportation.

The scope of the claims should not be limited by the preferred embodiments set forth in the examples, but should be given the broadest interpretation consistent with the description as a whole.

What is claimed is:

1. A collapsible stool for easy storage having a collapsible bench body member, a bench body support panel, and a bench cap;

wherein said bench body member when in an expanded state forms a four-sided cylindrical body, said four-sided cylindrical body having four walls, a plurality of soft sealable members attached to an end of the four-sided cylindrical body, and a zipper adapted to connect the soft sealable members to form a soft sealed end when said bench body member is in the expanded state, each of said four walls being made of a soft exterior layer and a solid composite panel that is enclosed within the soft exterior layer;

said bench body support panel being mountable within said bench body member when said bench body member is in the expanded state; and said bench cap being mountable on said bench body member when said bench body member is in the expanded state;

characterized in that said bench cap is a non-collapsible cap-shaped body formed by a bench cap surface member and bench cap walls to which said bench cap surface member is connected, each of said bench cap surface member and said bench cap walls being made of a soft exterior layer and a solid composite panel enclosed within the soft exterior layer; and when said collapsible stool is in a stored state, said bench body support panel and said bench body member in a collapsed state are disposed in said non-collapsible bench cap, and the sum of the thickness of said bench body support panel and said bench body member in its collapsed state is equal to the height of said bench cap inner walls.

2. The collapsible stool for easy storage according to claim 1, wherein the four-sided cylindrical body has a first end and a second end, the first end of the four-sided cylindrical body being attached to the soft sealable members; and wherein the bench cap is mountable on the bench body member at the second end of the four-sided cylindrical body when the bench body member is in the expanded state.

* * * * *